United States Patent [19]

Shelepov et al.

[11] 4,101,725

[45] Jul. 18, 1978

[54] HEARTH ELECTRODE FOR MELTING FURNACES

[76] Inventors: Nikolai Semenovich Shelepov, ulitsa Geroev Kosmosa, 2a, kv. 96; Valery Alexeevich Kildjushev, ulitsa Kuibysheva, 23, kv. 18; Evgeny Mitrofanovich Kitaev, Ploschad Revoljutsii, 4, kv. 37; Vissarion Makarovich Dubodin, 2 Mokhovoi proezd, 24, kv. 7; Vladimir Alexeevich Kochetkov, Bulvar Jubileiny, 29, kv. 15, all of Gorky, U.S.S.R.

[21] Appl. No.: 714,605

[22] Filed: Aug. 16, 1976

[51] Int. Cl.[2] ..... H05B 7/08

[52] U.S. Cl. ..... 13/18

[58] Field of Search ..... 13/2, 6, 18, 1, 9

[56] References Cited

U.S. PATENT DOCUMENTS

| | | | |
|---|---|---|---|
| 1,271,093 | 7/1918 | Snyder | 13/18 X |
| 2,599,779 | 6/1952 | Rajtora | 13/18 |
| 3,828,107 | 8/1974 | Sone | 13/1 |

*Primary Examiner*—R. N. Envall, Jr.

*Attorney, Agent, or Firm*—Lackenbach, Lilling & Siegel

[57] ABSTRACT

A hearth electrode for melting furnaces having a cylinder with the outer surface of the bottom thereof being adapted for contacting the melt stock or melt, and the inner space thereof being used for the circulation of a coolant. The electrode is provided with means for detecting local burnings-through or consumption by burning in the bottom thereof, in the form of a system of conduits arranged in cross-sectional planes of the bottom between the outer surface and inner space thereof. The conduits are filled with gas under a pressure different than the static pressure within the melting furnace, and connected with pressure sensors.

7 Claims, 2 Drawing Figures

HEARTH ELECTRODE FOR MELTING FURNACES

Figure 1:
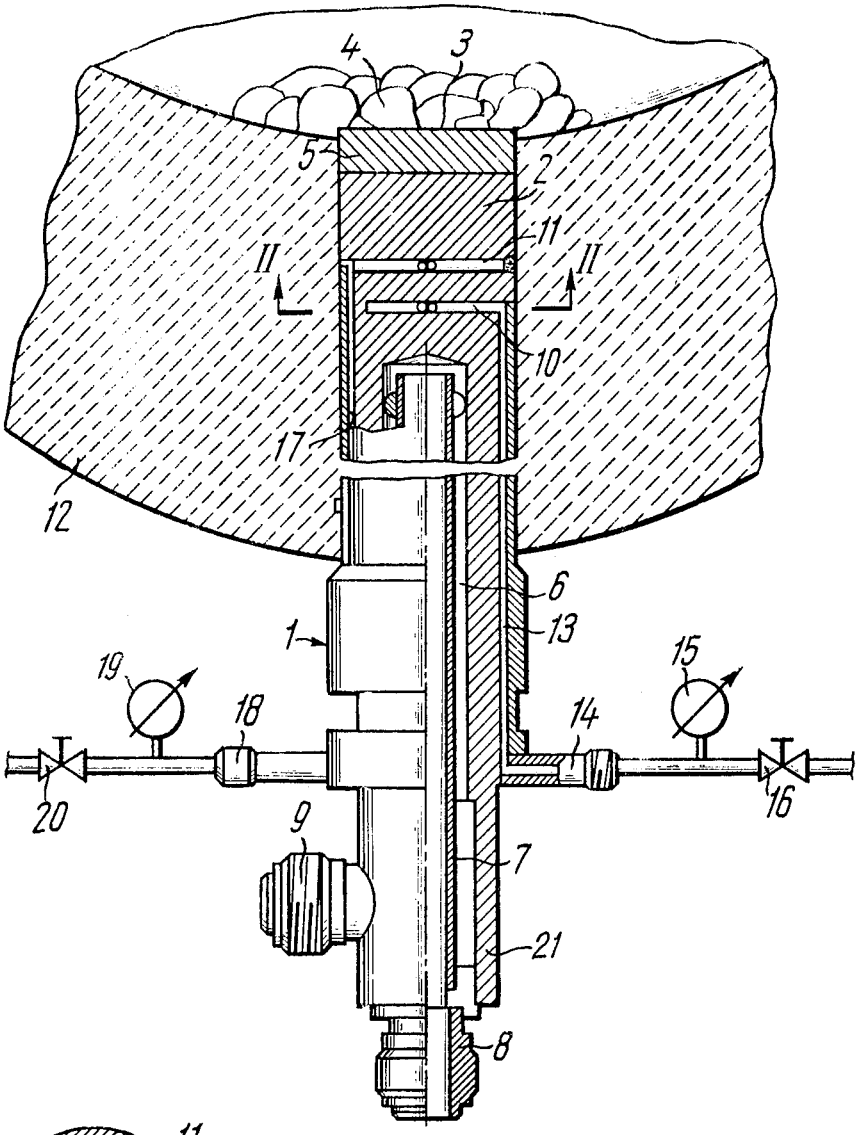

The present invention relates to electrometallurgy, and more particularly to plasma-arc furnaces, and concerns the structure of hearth electrodes used therein.

This invention is best suited for use in the furnaces wherein steels and alloys are smelted at a high temperature melting process.

Known in the present state of the art is a hearth electrode in the form of a copper cylinder, the bottom thereof being adapted for contacting the melt stock or melt.

In the course of using this type of hearth electrodes it has been found that microarcs are prone to form between the melt stock and the hearth electrode at the initial stage of melting. This causes local burnings-through or consumption by burning in the bottom thereof, which may result in leakage of water from the water-cooled space of the electrode to the liquid metal within the molten bath of the furnace, this being extremely hazardous as a furnace explosion is possible. Local burnings-through or consumption by burning of the electrode are also possible to occur with the metal being extensively overheated within the furnace, or with the electrode bottom having local flows. To ensure higher reliability, the bottom of the electrode is provided with a steel plate rigidly secured thereto. This, however, may only slow down the process of gradual local burning through, or consumption by burning but will not eliminate it altogether.

Therefore, it is extremely important to carry out control over the occurence of local burnings-through or consumption by burning in the bottom of the hearth electrode. Such control can be effected by following a temperature difference in the water coolant passing into the inner space of the electrode and outgoing therefrom. However, the temperature difference in the water coolant at the local burning-through, being insignificant, this type of control is not reliable enough.

Accordingly, it is an object of the invention to provide a hearth electrode having a structure enabling detection of the emergency state of the electrode whenever a local burning-through in the bottom thereof might occur.

This object is attained by a hearth electrode provided for use in melting furnaces, which electrode is made as a copper cylinder having the outer surface of the bottom thereof adapted for contacting the melt stock or melt, and the inner space thereof being used for delivering a water coolant thereinto. The electrode is provided with means for detecting local burnings-through or consumption by burning in the bottom thereof, and said means is formed by a system of radial conduits distributed uniformly all along the electrode cross-section and lying in at least one cross-sectional plane of the bottom between the outer surface and the inner space thereof. The conduits are filled with gas under a pressure differential, such as a gas pressure exceeding the static pressure within the melting furnace, and the conduits are connected with gas pressure sensors.

This type of structure of the hearth electrode makes it possible to detect an emergency state of the electrode in case of a local burning-through occuring in the bottom thereof and extending as far as the conduits filled with gas. Such pressure change occuring upon reaching the conduits sends an alarm so as to thus prevent explosion of the furnace.

Figure 2:
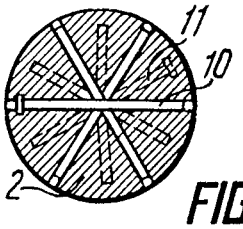

For a better understanding of the invention, a description of a specific embodiment thereof is described hereinbelow along with reference to the accompanying drawings, wherein:

FIG. 1 is a partial longitudinal sectional view of a hearth electrode for melting furnaces in accordance with the invention; and FIG. 2 is a sectional view taken along line II—II in FIG. 1.

A hearth electrode for melting furnaces is made as a copper cylinder 1 (FIG. 1) with a bottom 2 having an outer surface 3 adapted for contacting a melt stock 4 or a melt. The upper part of the electrode bottom 2 is made as a steel plate 5 which serves to improve the reliability thereof. Mounted within an inner space 6 of the electrode is a pipe 7 connected with a fluid inlet manifold 8 and with a fluid exhaust manifold 9. The hearth electrode is provided with means for detecting local burnings-through or consumption by burning in the bottom 2 thereof, and such means are formed by a system of radial conduits 10 and 11 distributed uniformly all along the electrode cross section. The conduits 10 and 11 lie in two cross-sectional planes of the bottom 2 between the outer surface 3 (FIG. 1) and the inner space 6 thereof. To attain higher reliability of the means for detecting local burnings-through, the conduits 11 are offset in the cross-sectional plane with respect to the conduits 10, as shown in FIG. 2. The conduits 10 and 11 are filled with gas under a pressure exceeding the static pressure within the melting furnace having the hearth electrode lined in a hearth 12 thereof (FIG. 1). The system of the conduits 10 is connected through a conduit 13 and a sleeve 14 with a pressure sensor 15 and closed by a valve 16. The system of the conduits 11 is similarly connected through a conduit 17 and a sleeve 18 with a pressure sensor 19 and is closed by a valve 20.

The conduits 10 and 11 are filled with gas under a pressure, higher than the static pressure within the melting furnace, prior to putting the furnace into operation. After the filling-up procedure the valves 16 and 20 are closed so that the gas within the conduits 10 and 11 is maintained under a constant static pressure controlled by the sensors 15 and 19 throughout the operating cycle of the furnace.

With the furnace in operation, the water coolant flows at a preset rate into the inner space 6 of the electrode via the sleeve 8 and out of said space through the exhaust manifold 9, thereby effectively absorbing the heat from the bottom 2 of the electrode.

In the event microarcs forming between the melt stock 4 and the bottom 2, or overheating of metal in the furnace, or else in the event of local defects in the electrode bottom 2, local burning-through are liable to occur therein. In case a local burning-through in the bottom 2 of the hearth electrode extends far enough to reach the system of the radial conduits 11, the tightness of the system of the conduits 11 is disturbed, and the pressure in such an arrangement where it is higher than the furnace sharply goes down, and the pressure sensor 19 sends an alarm signal indicating the emergency state of the hearth electrode. Where there is but one system of radial conduits 11, the furnace is halted or otherwise put out of operation and the liquid metal is poured out therefrom. Where there is a second system of radial conduits 10, the production capacity of the furnace is reduced and the melting process is completed. In the event of a burning-through occuring in the bottom 2 and extending as far as to reach the second system of the radial conduits 10, an alarm signal is likewise produced and the metal is instantly poured out from the furnace. Accordingly, any pressure change in the conduits signals a furnace condition to the operator.

Thus, it becomes possible to prevent the occurence of local burnings-through or consumption by burning in the bottom 2 before reaching the water-filled inner space 6 thereof, which otherwise would cause water leakage from the inner space 6 into the furnace. Thereby the danger of the furnace explosion is precluded.

What is claimed is:

1. A hearth electrode for melting furnaces comprising a cylinder, one end of said cylinder having an outer surface thereof and being adapted for contacting a melt stock or melt within the melting furnace, an inner space of said cylinder being adapted for providing a coolant passageway; passage means for detecting local burnings-through or consumption by burning in said bottom being filled with gas under a pressure differential with respect to the static pressure within the melting furnace, said passage means being provided all along the electrode cross section and lying in a longitudinal plane of said bottom between said outer surface and said inner space of the electrode; and a sensor for pressure control in communication with said passage means for detecting a pressure change in said passage means.

2. The hearth electrode according to claim 1, wherein the pressure in said passage means exceeds said static pressure within said furnace.

3. The hearth electrode according to claim 1, wherein further passage means, for detecting local burnings-through or consumption by burning in said bottom, are provided in said electrode all along the cross section thereof, and are disposed below said passage means in another longitudinal plane of said bottom.

4. The hearth electrode according to claim 2, including a pressure sensor in communication with said further passage means for signaling an alarm upon local burnings-through or consumption by burning reaching said further passage means.

5. The hearth electrode according to claim 3, wherein said passage means and said further passage means are distributed uniformly all along said electrode cross section.

6. The hearth electrode according to claim 5, wherein said further passage means are offset in said cross-sectional plane with respect to said passage means.

7. The hearth electrode according to claim 1, wherein said cylinder is made of copper.

* * * * *